US008620464B1

(12) United States Patent
Weiland

(10) Patent No.: US 8,620,464 B1
(45) Date of Patent: Dec. 31, 2013

(54) VISUAL AUTOMATED SCORING SYSTEM

(75) Inventor: Christopher J. Weiland, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/385,473

(22) Filed: Feb. 7, 2012

(51) Int. Cl.
*G06F 19/00* (2011.01)

(52) U.S. Cl.
USPC ..... 700/92

(58) Field of Classification Search
USPC ..... 700/92
See application file for complete search history.

(56) References Cited

U.S. PATENT DOCUMENTS

| | | | | | |
|---|---|---|---|---|---|
| 2,938,201 | A | * | 5/1960 | Thornton | 342/52 |
| 2,971,274 | A | * | 2/1961 | Thornton | 434/12 |
| 3,793,481 | A | * | 2/1974 | Ripley et al. | 348/139 |
| 4,276,028 | A | * | 6/1981 | Gwynn | 434/20 |
| 4,289,960 | A | | 9/1981 | Smith et al. | 250/222.2 |
| 4,333,106 | A | * | 6/1982 | Lowe | 348/142 |
| 4,611,993 | A | * | 9/1986 | Brown | 434/21 |
| 5,194,006 | A | * | 3/1993 | Zaenglein, Jr. | 434/19 |
| 5,575,438 | A | * | 11/1996 | McGonigle et al. | 244/13 |
| 5,577,733 | A | * | 11/1996 | Downing | 273/348 |
| 5,614,910 | A | | 3/1997 | Bradley et al. | 342/119 |
| 5,988,645 | A | * | 11/1999 | Downing | 273/348 |
| 5,999,210 | A | * | 12/1999 | Nemiroff et al. | 348/135 |
| 6,125,308 | A | * | 9/2000 | Hills et al. | 701/1 |
| 6,198,501 | B1 | * | 3/2001 | Nemiroff et al. | 348/135 |
| 6,224,387 | B1 | * | 5/2001 | Jones | 434/252 |
| 6,717,684 | B1 | * | 4/2004 | Fikes et al. | 356/614 |
| 6,875,019 | B2 | * | 4/2005 | Huang et al. | 434/14 |
| 6,910,657 | B2 | * | 6/2005 | Schneider | 244/3.11 |
| 7,498,982 | B1 | | 3/2009 | Kelly et al. | 342/356.52 |
| 7,920,182 | B2 | * | 4/2011 | Jacob et al. | 348/241 |
| 8,012,838 | B2 | | 9/2011 | Kim | 438/286 |
| 8,244,469 | B2 | * | 8/2012 | Cheung et al. | 701/519 |
| 8,423,224 | B1 | * | 4/2013 | Fuciarelli et al. | 701/23 |
| 2003/0082502 | A1 | * | 5/2003 | Stender et al. | 434/23 |
| 2003/0152892 | A1 | * | 8/2003 | Huang et al. | 434/11 |
| 2005/0077424 | A1 | * | 4/2005 | Schneider | 244/3.11 |
| 2008/0233543 | A1 | | 9/2008 | Guissin | 434/19 |
| 2009/0281660 | A1 | * | 11/2009 | Schmidt et al. | 700/258 |
| 2010/0017046 | A1 | * | 1/2010 | Cheung et al. | 701/2 |
| 2010/0097460 | A1 | * | 4/2010 | Abernathy | 348/140 |
| 2011/0170798 | A1 | * | 7/2011 | Tidhar | 382/276 |
| 2011/0315767 | A1 | * | 12/2011 | Lowrance | 235/404 |
| 2013/0085981 | A1 | * | 4/2013 | Fuciarelli et al. | 706/52 |

* cited by examiner

*Primary Examiner* — Seng H Lim
(74) *Attorney, Agent, or Firm* — Gerhard W. Thielman, Esq.

(57) ABSTRACT

A visual automated score system (VASS) is provided to enable computerized accuracy assessment of weapons systems through video photography. Images are fed into a computer which tracks the intended target, detects impact points and then provides human operators with an automatically computed miss distance based on the cross-correlation of at least two video images. The VASS may then provide feedback to the weapons system to correct and direct gunfire.

13 Claims, 4 Drawing Sheets

GEOLOCATION PROCESSOR
400
410
Airframe Heading 412
Airframe Altitude 414
Camera Bearing/Tilt 416
Range 418
Calculate Target Coordinates 460
Output is Coordinates of all Objects Tracked in Images 470
150
430
Camera Field of View 420
Calculate Pixel /Angle Deflection From Camera Pointing Angle
Compute Pixel Angle Relative to Camera Pointing Angle 450
Input Pixel Coordinates 440

VISUAL AUTOMATED SCORING SYSTEM

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to the field of scoring systems, and more specifically to a computerized accuracy assessment for weapons using video photography. In particular, the invention provides an accuracy assessment process to determine the proximity of an impact site from a ballistic weapon to an intended target.

The accuracy of a weapon system is the ability of the weapon system to effectively engage a target, and accuracy is usually summarized by indicating the distance between the target and where a weapon actually hit. All weapons systems must have their accuracy assessed. Weapons systems include the complete hierarchy of people and technology responsible for engaging a target.

In the case of naval guns, the guns are first tested on a range and then at sea. Accurate naval gunfire requires a number of different systems working together in harmony, and thus total naval gunfire accuracy is assessed during the at sea testing. Conventional methods for scoring, or assessing, weapon accuracy are cumbersome and difficult to implement. For example, humans may use theodolites to triangulate the fall-of-a-shot (FOS). This conventional method, introduces many inaccuracies, resulting in inaccurate calculations. Theodolites are also cumbersome to maneuver and operate.

Hydroacoustic buoys at known positions may also be used to triangulate the FOS. These conventional systems are cumbersome and error prone. For example, each buoy position must be precisely known for accurate triangulation of the FOS. Such positioning information is not possible, especially in rough waters, and this decreases FOS accuracy. Additionally, for testing at sea these systems must first be deployed in the open ocean before testing can commence, and then collected upon completion of testing.

Further problems exist when trying to score weapons systems in the field. Currently, human forward observers must direct firing missions to provide feedback as to the accuracy of the weapon. In some situations, it may not be possible for forward observers to see a target. For example, weather conditions, dust and debris, and other visual impairments may limit or impair a forward observer's ability to actually see a target, and some conditions may pose hazardous for a forward observer.

SUMMARY

Conventional target accuracy assessment processes yield disadvantages addressed by various exemplary embodiments of the present invention. In particular, a visual automated scoring system (VASS) using an accuracy assessment process is provided for determining the accuracy of a weapons system in the field without requiring forward observers to enable computerized accuracy assessment of weapons systems through video photography.

Images are fed into a computer which tracks the intended target, detects impact points and then provides human operators with an automatically computed miss distance. The VASS may then provide feedback to the weapons system to correct and direct gunfire. The VASS scores gunfire in both Line of Sight (LOS) and Non Line of Sight (NLOS) modes.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
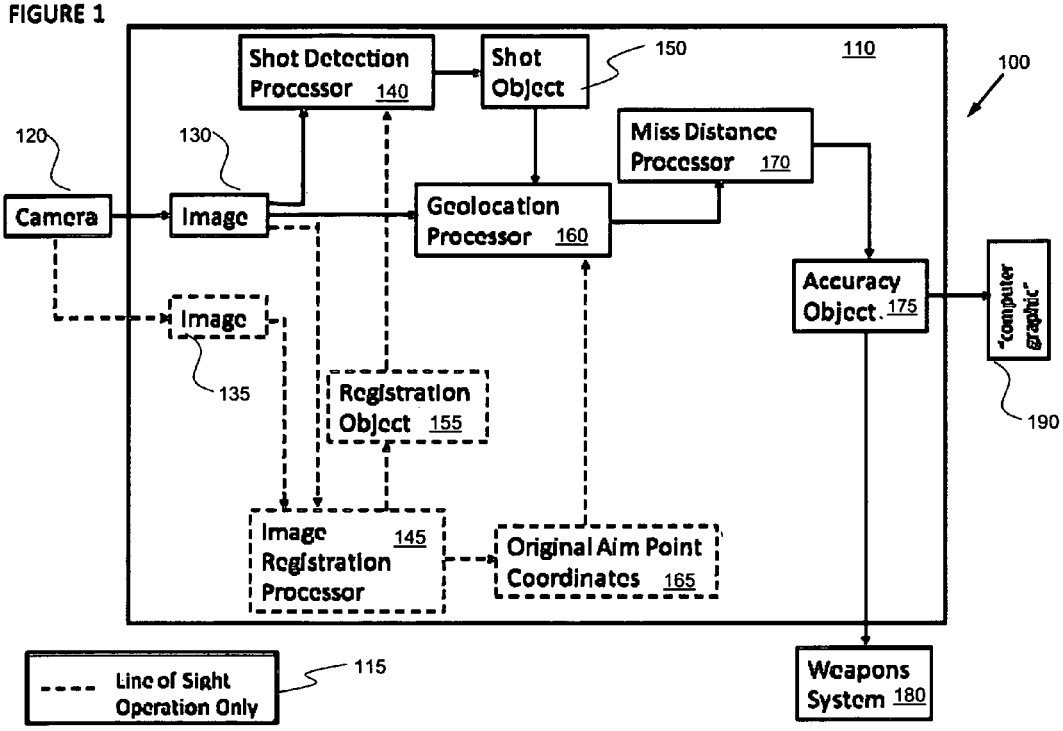
FIG. 1 is a flowchart view of a visual automated scoring system.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

In accordance with a presently preferred embodiment of the present invention, the components, process steps, and/or data structures may be implemented using various types of operating systems, computing platforms, computer programs, and/or general purpose machines. In addition, those of ordinary skill in the art will readily recognize that devices of a less general purpose nature, such as hardwired devices, or the like, may also be used without departing from the scope and spirit of the inventive concepts disclosed herewith. General purpose machines include devices that execute instruction code. A hardwired device may constitute an application specific integrated circuit (ASIC) or a floating point gate array (FPGA) or other related component.

As used herein, the term "affine transformation" refers to a mapping from one vector space to another. Affine transforms, in this context, refer to several specific mappings, including: scaling, rotation, shear, and translation. Only affine transforms are used in this text to demonstrate the principles under which VASS operates, although it is understood that under certain conditions other image transformations, such as a projective transformation, may be used. As used herein, the term "change-point analysis" refers to an analytical operation performed on a set of time-ordered data to detect changes in those data. As used herein, the term "weapons system" means the complete hierarchy of people and technology responsible for engaging a target. As used herein, the term "image preprocessing" refers to standard image processing steps such as binarization and median filtering. Frequency filtering operations may fall under this label as well.

It should be understood that the drawings are not necessarily to scale; instead, emphasis has been placed upon illustrating the principles of the invention. In addition, in the embodiments depicted herein, like reference numerals in the various drawings refer to identical or near identical structural elements. [substantial repeat of drawings intro] Moreover, the terms "substantially" or "approximately" as used herein may be applied to modify any quantitative representation that could permissibly vary without resulting in a change in the basic function to which it is related.

FIG. 1 shows a flowchart view 100 of an exemplary visual automated scoring system (VASS) 110 showing two embodiments distinguished in a legend 115 and operating in conjunction with a remote camera 120. First and second modes are predicated respectively on Line of Sight (LOS) and Non Line of Sight (NLOS). In LOS mode, the VASS 110 receives at least first and second image files 130, 135 from the camera 120, distinguished respectively by being LOS and NLOS. In some exemplary embodiments, multiple cameras may be disposed near a target. In other exemplary embodiments, camera 120 may be installed on a mobile platform, such as an aircraft, ground vehicle or vessel.

In the exemplary embodiment shown, the first LOS image 130 embodies an image obtained of a target area prior to a shot from a weapons system, while the second NLOS image 135 reflects an image obtained after a shot is fired from a weapons system. In further exemplary embodiments, additional images from the time during a shot may be included with the images 130, 135. In still further exemplary embodiments, image files may also be provided from different spatial locations around a target area.

A Shot Detection Processor 140 receives the first LOS image 130, and an Image Registration Processor 145 receives the second NLOS image 135. The Detection Processor 140 issues a Shot Object 150, and the Registration Processor 145 issues a Registration Object 155. A Geolocation Processor 160 also receives the first LOS image 130 and the Shot Object 150. The Registration Processor 145 provides Original Aim Point Coordinates 165, which the Geo-location Processor 160 receives. The combination of the first image 130, the Shot Object 150 and the Coordinates 165 enable the Geolocation Processor 160 to provide input to a Miss Distance Processor 170, which produces an Accuracy Object 175. This result feeds into a Weapon system 180 and a Computer Graphic 190 for render on a display monitor.

Figure 2:
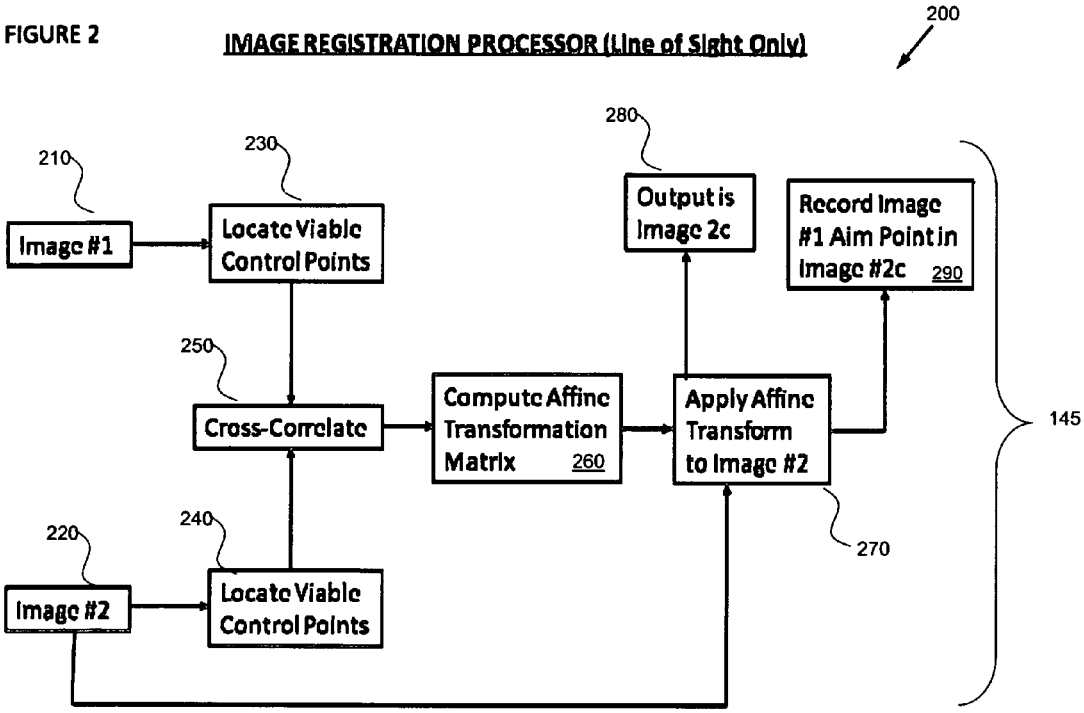
FIG. 2 is a flowchart view of an image registration processor.

FIG. 2 shows a flowchart view 200 of the Image Registration Processor 145, which receives inputs from Image #1 210 and Image #2 220 (analogous to 130, 135). A first Locate Viable Control Points processor 230 receives Image #1 210, and a second Locate Viable Control Points processor 240 receives Image #2 220, both processors feeding to a Cross-Correlation processor 250. A Computation processor 260 receives the cross correlation result and performs an Affine Transformation in Matrix form.

A Transformation processor 270 applies an Affine Transform to Image #2 220 based on the matrix received from the Computation processor 260. The Transformation processor 270 supplies an output Image #2c 280, which is stored in a Recorder 290 for an Aim Point in Image #2c 260. The transform matrix enables the two images to de-rotate or de-translate a first image (1) with respect to a second image (2). This matrix can then be applied to provide a corrected third Image #2c 280. Consequently, the gun aim point in Image #1 210 is transmitted to Image #2c 280, despite lack of LOS for the target.

In the exemplary embodiment shown, the control points may be arbitrarily chosen or calculated for optimal location. The calculation could be in the form of local image spectral content or entropy, such that control points will only be placed at optimal locations for cross-correlation, and guide the placement of the control points for maximum accuracy. The control points must be placed accurately for the affine transformation matrix to be computed accurately. These operations represent image registration steps.

Artisans of ordinary skill will recognize that a Line-of-Sight (LOS) weapon system is one where the gunner can directly see the target. An example is a gunner in an aircraft shooting at a ground target. The gunner is watching the target and where the rounds fall. By contrast, a Non-Line-of-Sight (NLOS) weapon system is one where the gunner cannot directly see the target. This could be due to extreme firing ranges (curvature of the earth prevents observation. An example would be a Navy vessel firing its guns at a remote target. The gunner cannot directly see the target, which could be 30 km away. Rather, the gunner relies on personnel at the target sight to assess weapons effects and score the rounds. Only a single camera receives these images. The two images come in at distinct and separate times, as defined by the camera recording rate.

Figure 3:
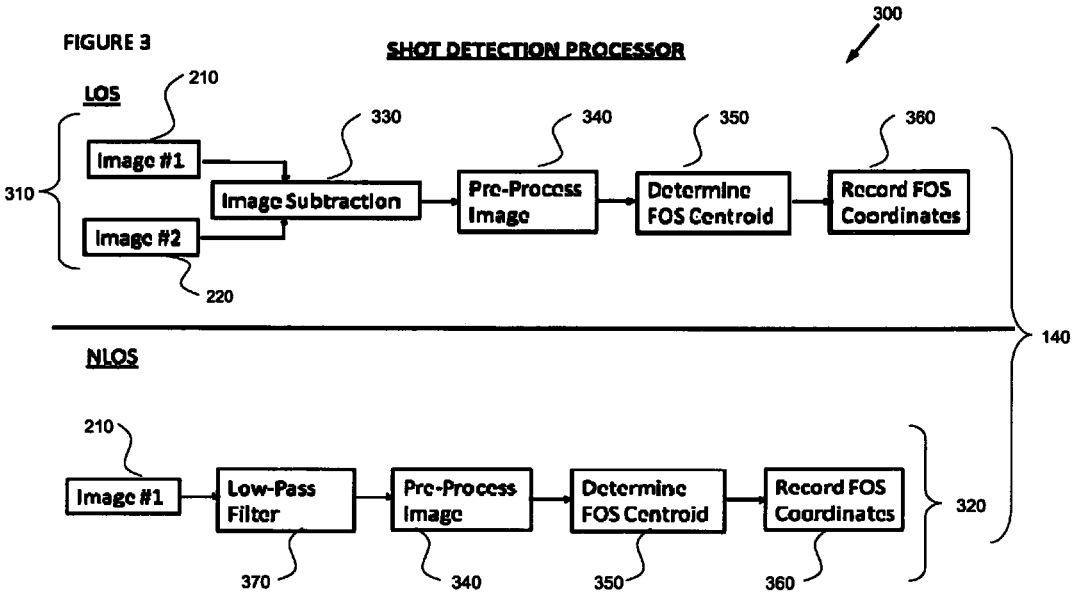
FIG. 3 is a flowchart view of a shot detection processor.

FIG. 3 shows a flowchart view 300 of the Shot Detection Processor 140. This includes operations for a LOS detection process 310 and an NLOS detection process 320. For the LOS process 310, the first Image #1 210 and second Image #2 220 combine into a difference process for Image Subtraction 330. This produces a Pre-Process Image 340 result, leading to an FOS de-termination process to Determine FOS Centroid 350 that produces Record FOS coordinates 360. By contrast, the NLOS process 320 transverses Image #1 210 to a Low-Pass Filter 370 to yield a Pre-Process Image 340, used to proceed Determine FOS Centroid 350 and produce Record FOS Coordinates 360.

Figure 4:
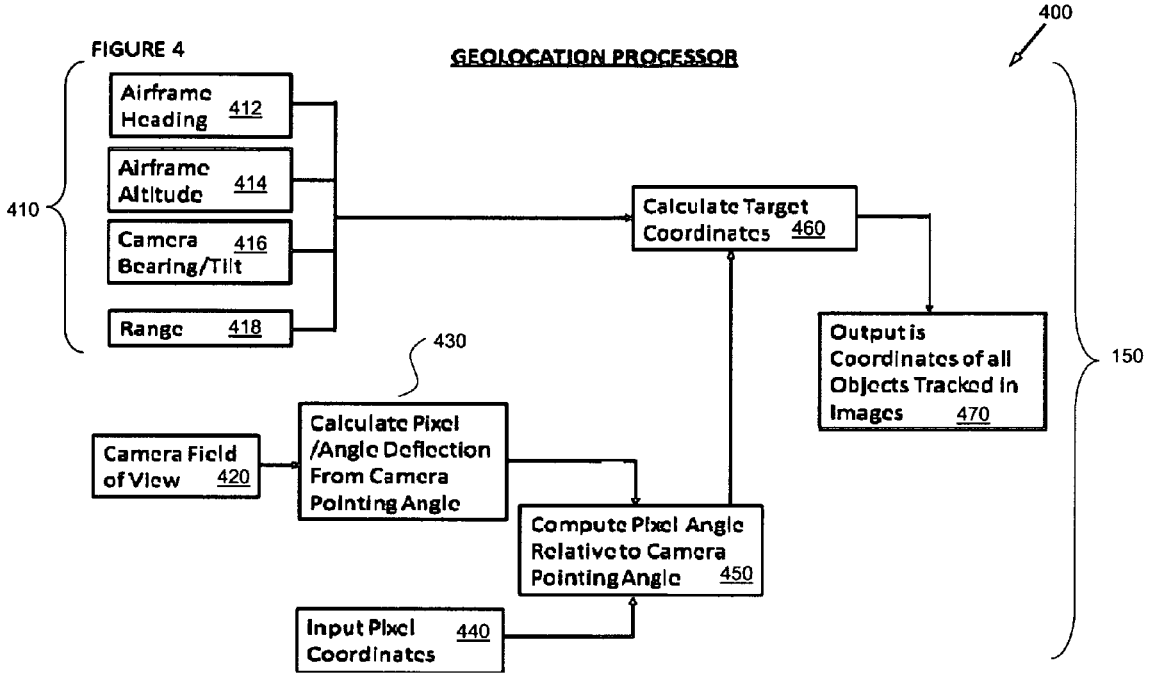
FIG. 4 is a flowchart view of a geolocation processor.

FIG. 4 shows a flowchart view 400 of the Geolocation Processor 150. Input information on Image Source Characteristics 410 for the airframe platform that carries the camera 120 includes Heading 412, Altitude 414, Bearing/Tilt 416, and Range 418. The camera 120 has a Camera Field of View 420. A Deflection Calculation Processor 430 calculates Pixel/Angle Defection—Pointing Angle. Combined with Pixel Coordinates 440, the results from the Calculation Processor 430 can be received by an Angle Computation Processor 450 determines Pixel Angle relative to camera pointing angle from both Deflection and Angle results. A computation processor 460 receives relative angle from the Processor 450 as well as camera platform characteristics 410 to yield an Output 470 of coordinates from all objects tracked in the images.

In the exemplary embodiment shown, LOS image files 130, 135 are transmitted to the Image Registration Processor 145, which locates viable control points in Images #1 210 and #2 220 and computes a transform matrix between these two images 210, 220 so as to de-rotate/de-translate, etc, Image #2 220 with respect to Image #1 210. The Transform processor 270 applies the trans-form matrix to Image #2 220 to yield corrected Image #2c 280. As a result of this transform, the gun aim point in Image #1 210 is transmitted to Image #2c 280.

In the exemplary embodiment shown for LOS, the control points may be arbitrarily chosen or calculated for optimal location. The calculation could be in the form of local image spectral content or entropy, such that control points will only be placed at optimal locations for cross-correlation, and will guide the placement of the control points for maximum accuracy. The control points must be placed accurately for the affine transformation matrix to be computed accurately.

For LOS in the view 200, at least two Images 210, 220 are registered. Variable Control Point Locations are then determined in cor-responding Processors 230, 240 in each respective Image and cross-correlated in the subsequent Processor 250. The result of the cross-correlation can be used with the image data from one of the images (e.g., the second Image 220) in an Affine Transformation in the Processor 270. These steps together are the Image Registration operations.

In the exemplary embodiment shown for LOS, Images #1 210 and #2c 280 are sent to the Shot Detection Processor 140, which executes at least one automated shot detection algorithm to determine the geographical position of a shot or shots fired by the weapons system 180. In the embodiment shown, images 210 and 280 are subtracted from another and a series of image preprocessing steps are performed. The resulting object contains only the fall-of-a-shot calculation, whose centroid is computed and taken as the FOS coordinates in units of pixels relative to the camera frame of reference. The Shot Detection Processor 140 produces the Shot Object 150.

In some exemplary embodiments for NLOS, the shot detection algorithm only operates on one image at a time. In this case, an additional filtering operation is applied to remove high-frequency noise from the image. High-frequency noise could, for example, be reflections of light off of water waves or the waves themselves. The FOS is also located using a change-point algorithm instead of image subtraction. Image preprocessing steps can be also applied to any image in this embodiment.

In another exemplary embodiment, the shot detection algorithm works on multiple camera images. The process operates on each image 130, 135 independently. The operations for the Shot Detection Processor 140 may also employ pattern recognition algorithms, such as circle or ellipse detection, to further refine accurate calculation of the descent trajectory output 470 of Shot Image Coordinates. In the exemplary embodiment shown for LOS, the Shot Object 150 is sent to the Geolocation Processor 160, which collects several inputs to convert the position of objects in the camera frame-of-reference to position in a world coordinate system, such as Latitude and Longitude. The Geolocation Processor 160 may utilize or be incorporated in software or hardware in an unmanned air vehicle (UAV) to compute ground coordinates from a camera 120 disposed on a UAV. In other exemplary embodiments, the Geolocation Processor 160 may be custom-configured for specific regions or uses.

In some exemplary embodiments, the Geolocation Processor 160 may contain subprocessors. For example, the Geolocation Processor 160 may contain a control point locator subprocessor which analyzes images 130, 135 to determine a plurality of control points, a correlation subprocessor that compares images 130, 135 to correlate the control points identified for each image, and an affine transformation subprocessor that creates an affine transformation matrix based on the correlation completed by correlation subprocessor. In still further exemplary embodiments, these subprocessors may be independent processors of VASS system 110.

The Geolocation Processor 160 may operate using fixed camera bearings from a distribution of static mounted cameras 120. In this instance, inputs 410 such as aircraft altitude 414 and aircraft heading 412 will be unavailable, instead replaced by the static camera altitude and the static camera fixed reference bearing (i.e., towards true North). In the exemplary embodiment shown, the Geolocation Processor 160 produces a geolocation object that includes world coordinates of the shot's fall. The Geolocation Process 160 can also be used to specify the world coordinates of other objects of importance in the image 130, 135. The Geolocation Process 160 sends the geolocation object to the Miss Distance Processor 170.

The Miss Distance Processor 170 uses the geographical shot locations determined by the Shot Detection Processor 140 and compares the shot locations with the geographical position of the target identified by the Geolocation Processor 160 to determine the distance between where the weapons system 180 was aiming and where a shot or shots actually fell. A resulting Accuracy Object 175 contains the miss distance information. In some exemplary embodiments (such as the NLOS mode 320), the Shot detection Processor 140 may contain subprocessors. For example, the Shot Detection Processor 140 may include a Filter subprocessor 370 that applies a low-pass filter to an image 130, a change-point subprocessor which determines the statistical likelihood of an object in the image 130, and an FOS subprocessor to compute FOS pixels.

In some exemplary embodiments, the Miss Distance Processor 170 transmits the Accuracy Object 175 to the graphic 190 on a computational user interface to be graphically displayed and thereby enable operators of the weapons system 180 to correct the weapon system's alignment. The Accuracy Object 175 may also be relayed directly to weapons system 180 in a feedback loop so that the weapons system 180 automatically corrects its alignment based on input from VASS 110.

By providing quantified miss distances, the gunner/fire control computer can adjust its aim point. Example: when someone engages in target shooting at a gun range, firing one round and hitting left of the bulls-eye tells one that next time that person shoots, to aim further to the right. Humans are pretty smart at adapting themselves like this, but a fire control computer doesn't work in terms of "aim a little bit to the right," but rather needs an actual number. The fire control computer will know that the gun shot 1.38° (degrees) to the right of the actual target, and thus the system recognizes the necessity to correct its aim point accordingly.

VASS has only been used to score gunfire so far. It can be used with any weapon system that generates a large enough signature compared to noise for the software to detect the FOS coordinates.

VASS has been used to score a) naval gunfire of a 5-inch gun here at the Potomac River Test Range (NLOS) and b) gunfire from an airplane shooting at a ground target (LOS). At least two Images: #1 210 and #2 220 are registered. Variable control point locations are then located in each of the two Images 230, 240 and cross-correlated 250.

The result of the cross-correlation is used with the image data from one of the images in the Affine Transformation Process 260. These steps together are the image registration. The affine transformation step is necessary to put Image 220 in the same frame of reference as Image 210. Because both images are taken a small time apart from a moving camera, Image 220 can be rotated and translated with respect to Image 210. The affine transformation can "de-rotate" and "de-translate" Image 220, so that Images 210 and 220 can be overlaid atop of one another. This explains why the shot detection algorithm successfully operates for the LOS embodiment: if the two images are subtracted, all that will remain is anything new in the Image 220, which is the FOS.

For the LOS configuration, the result of the affine transformation imposed on Image 220 is used in an image subtraction with the image subtraction process 330. Based off the image subtraction of 330, the visual automated scoring system uses a shot detection algorithm to detect the location or locations of the shots fired using the weapons system 140. The shot detection steps involve a pair of path operations 370 and 170 for image subtraction in LOS and image frequency filtering in NLOS. Both paths use median filter and binarization. Pattern recognition techniques can be used to determine, for example, the shape of objects in the field of view. For the LOS configuration, to determine the accuracy of the shots fired, in 170, the results of the affine transformation can be used to track and record aim point, and combined with the results of the shot detection 370 and 170 to compute and record a miss distance in operation 290.

The hardware and/or software involved are common to any airframe for the embodiments shown on the flowcharts, especially FIG. 4. For airframes, bearing, altitude, range to target, etc. can be known. Once the Geolocation Processor 160 labels the coordinates of the original aim point and the fall of shot, common calculations give the miss distances.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A computer-implemented visual scoring apparatus for determining accuracy of targeting of a ballistic projectile fired against a target, said projectile striking an impact site, said apparatus comprising:

a geolocation processor that executes instructions of a geolocation algorithm on the impact site to provide impact coordinates and on the target to provide target coordinates;

a shot detection processor that executes instructions of an autonomous shot detection algorithm to determine that the projectile has been fired; and a miss distance processor that executes instructions for determining distance between the impact site and the target based on said impact and target coordinates.

2. The apparatus of claim 1, wherein said geolocation processor and said shot detection processor receives an image file from a camera.

3. The apparatus of claim 1, wherein said geolocation processor generates an affine transformation object.

4. The apparatus of claim 1, wherein said shot detection processor receives first and second image files.

5. The apparatus of claim 3, wherein said shot detection processor receives said transformation object from said geolocation processor.

6. The apparatus of claim 3, wherein said miss distance processor receives said at least one affine transformation object.

7. A computer-implemented visual automated scoring system for determining accuracy of ballistic targeting of a ballistic projectile fired against a target, said projectile striking an impact site, said scoring system comprising:

a geolocation processor that executes instructions of a geolocation algorithm;

a shot detection processor that executes instructions of an autonomous shot detection algorithm;

a miss distance processor that executes instructions for determining distance between the impact site and the target;

a remotely located camera; and a remotely located weapons system for firing the projectile.

8. The system of claim 7, wherein said camera is located on an UAV.

9. The system of claim 7, wherein said miss distance processor provides feedback to said at least one remotely located weapons system.

10. The apparatus of claim 2, wherein said shot detection processor preprocesses said image, and determines an impact centroid therefrom for a non-line-of-sight operation.

11. The apparatus of claim 1, further comprising:

an image registration processor for receiving first and second images from a camera in a line-of-sight operation to produce original aim position coordinates to provide to said geolocation processor; and a registration object for providing for determining occurrence of the projectile being fired to provide to said shot detection processor.

12. The apparatus of claim 11, wherein said shot detector processor subtracts said second image from said first image to produce a difference image, preprocesses said difference image, and determines an impact centroid therefrom for said line-of-sight operation.

13. The apparatus of claim 11, wherein said image registration processor locates first and second control points respectively from said first and second images, cross-correlates said control points to provide an affine matrix, transforms said affine matrix as an affine transform, applies said affine transform to said second image to produce an output transform image.

* * * * *